US006343712B1

(12) United States Patent
Flackett et al.

(10) Patent No.: US 6,343,712 B1
(45) Date of Patent: Feb. 5, 2002

(54) LIQUID DISPENSER

(75) Inventors: Glenn Flackett, Surrey; Andrew Halley, Leeds, both of (GB)

(73) Assignee: Shower Pets Limited (GB)

( * ) Notice: Subject to any disclaimer, the term of this patent is extended or adjusted under 35 U.S.C. 154(b) by 0 days.

(21) Appl. No.: 09/600,487

(22) PCT Filed: Jan. 13, 1999

(86) PCT No.: PCT/GB99/00010

§ 371 Date: Sep. 5, 2000

§ 102(e) Date: Sep. 5, 2000

(87) PCT Pub. No.: WO99/35949

PCT Pub. Date: Jul. 22, 1999

(30) Foreign Application Priority Data

Jan. 13, 1998 (GB) ..... 9800508

(51) Int. Cl.[7] ..... G01G 17/04

(52) U.S. Cl. ..... 222/78; 222/206; 222/212; 222/490; 222/494; 222/183

(58) Field of Search ..... 222/78, 206, 212, 222/215, 490, 494, 183

(56) References Cited

U.S. PATENT DOCUMENTS

| | | | | | |
|---|---|---|---|---|---|
| 2,771,219 | A | * | 11/1956 | Dewey | 222/78 |
| 3,105,612 | A | * | 10/1963 | Krasnoff et al. | 222/78 |
| 3,319,838 | A | * | 5/1967 | Bayles et al. | 222/215 |
| 3,388,835 | A | * | 6/1968 | Naughten | 222/78 |
| 3,608,793 | A | * | 9/1971 | VanLobenSels | 222/490 |
| 4,133,457 | A | * | 1/1979 | Klassen | 222/212 |
| 4,529,278 | A | | 7/1985 | Nugent | 350/631 |
| 4,728,006 | A | * | 3/1988 | Drobish et al. | 222/181 |
| 5,312,018 | A | * | 5/1994 | Evezich | 222/95 |
| 5,850,945 | A | * | 12/1998 | Frankel | 222/206 |

FOREIGN PATENT DOCUMENTS

| | | | | |
|---|---|---|---|---|
| DE | 2515034 | | 10/1976 | |
| DE | 29613906 | | 3/1997 | 5/12 |
| DE | 29613906 | U1 * | 6/1997 | A47K/5/12 |
| EP | 0176850 | | 4/1986 | 25/22 |
| FR | 1.334.606 | * | 4/1963 | |
| FR | 1334606 | | 7/1963 | 17/67 |
| FR | 2670661 | A1 * | 6/1992 | A47K/5/122 |
| FR | 2670661 | | 6/1992 | 5/122 |
| GB | 1207292 | * | 9/1970 | |
| GB | 1592401 | | 7/1981 | 41/2 |
| NL | 9400380 | | 10/1995 | 35/56 |

OTHER PUBLICATIONS

Photocopy of Plastic/Rubber Lizzard with Suction Cup. (Approximate Date—1996).*

* cited by examiner

*Primary Examiner*—Kevin Shaver
*Assistant Examiner*—Frederick C. Nicolas
(74) *Attorney, Agent, or Firm*—Bourque & Associates, PA

(57) ABSTRACT

A liquid dispenser has a housing containing a reservoir which is closed by a dispensing closure. Liquid is dispensed by squeezing the housing, whereupon the closure opens to dispense liquid from the reservoir. The housing has suction cups which allow the housing to be removeably stuck onto a vertical surface from which it can be pulled away when liquid is to be dispensed. After dispensing, the housing can be replaced at any position on the surface merely by pressing the cups onto the surface.

18 Claims, 3 Drawing Sheets

LIQUID DISPENSER

This invention relates to a liquid dispenser intended particularly for dispensing viscous liquids such as shampoos and liquid soaps. The invention is not however restricted to use with these liquids The dispenser could also be used to dispense food products such as ketchup or salad cream. Furthermore, the dispenser could also be used to dispense less viscous liquids including water.

Shampoo and liquid soap containers in the form of bottles which stand upright either require an expensive pump to dispense the contents, or have to be held upside down until the viscous liquid has flowed downwards far enough to reach the opening through which it can flow out or be "squeezed out". Other dispensers of the "squeeze to use" type such as shower gel dispensers are known which have a hook by which they can be suspended from a suitable fixed point. However suitable fixed points are not always available or easily accessible, for example to children.

According to the invention, there is provided a liquid dispenser comprising a reservoir for the liquid to be dispensed, a dispensing closure for the reservoir which is normally closed but which opens to dispense liquid when the reservoir is squeezed, and suction cups associated with the reservoir to allow the reservoir to be releasably attached to a vertical surface.

The dispenser preferably includes a housing within which the reservoir can be contained, and the housing is provided with the suction cups.

In a preferred form, the housing has a decorative shape, and in a particularly preferred form, the housing takes the shape of an animal. The dispenser can be arranged so that liquid is dispensed through the mouth of the animal shape.

The dispenser of the invention can thus be stuck at any position on the wall of a shower enclosure, or on the side of a bath, so that when showering or bathing, the dispenser and its contents of shampoo or soap are immediately accessible. To dispense liquid, the dispenser will normally be pulled off the wall, squeezed to dispense the required quantity of liquid, and then pressed against the wall again to reattach it until it is next required.

It will be apparent therefore that the suction cups are not intended to permanently attach the dispenser to a surface; rather the strength of attachment should be sufficient to hold the dispenser to the surface for the duration of showering or bathing whilst allowing it to be easily detached when liquid is to be dispensed.

The housing is preferably constructed to allow the reservoir to be refilled with liquid. To this end, the housing may be in two pieces which can be for example snap-fitted or screwed together. When the two pieces are separated, a refilling opening of the reservoir can be exposed. The reservoir may be separate from the housing so that it can be inserted in or extracted from a cavity within the housing. The reservoir can then be blow-moulded, for example from polyethylene. Alternatively, the reservoir may be formed directly within the housing itself.

The refilling opening of the reservoir can be normally closed by a cap which carried the dispensing closure. The closure can be of the type known as a "Zel" valve which has a slit membrane providing the closure, with the membrane being distended to open the slit when internal pressure is applied within the reservoir.

There are preferably two or three suction cups. The cups may be in line or grouped in a staggered array, the suction cups may be associated with a flexible, angled fin which is arranged to make contact at an angle with a surface on which the dispenser has been stuck, and to resist movement of the dispenser along the surface in a direction at right angles to the fin. The fin will normally be positioned between the suction cups and the dispenser mouth so that when the dispenser is stuck on a wall, the f in resists any tendency for the dispenser to slide down the wall.

The body is preferably moulded from an elastomeric plastics material such as "Evoprene" or "Bergaflex". The suction cups are preferably integrally moulded with the body, and may be of the same material or of a different material. If they are of a different material (optimised to give the desired suction properties) they may be preformed, either individually or as a unit incorporating a number of cups, and placed in the mould for the body, so that the body material is moulded around the cups.

In a preferred embodiment, the body is generally elongate, with the suction cups in line. The body may then have laterally extending limbs, designed as legs or arms of the animal shape, which help to ensure that the dispenser is correctly positioned against a surface to enable the suction cups to stick.

The invention will now be further described, by way of example, with reference to the accompanying drawings, in which.

Figure 1:
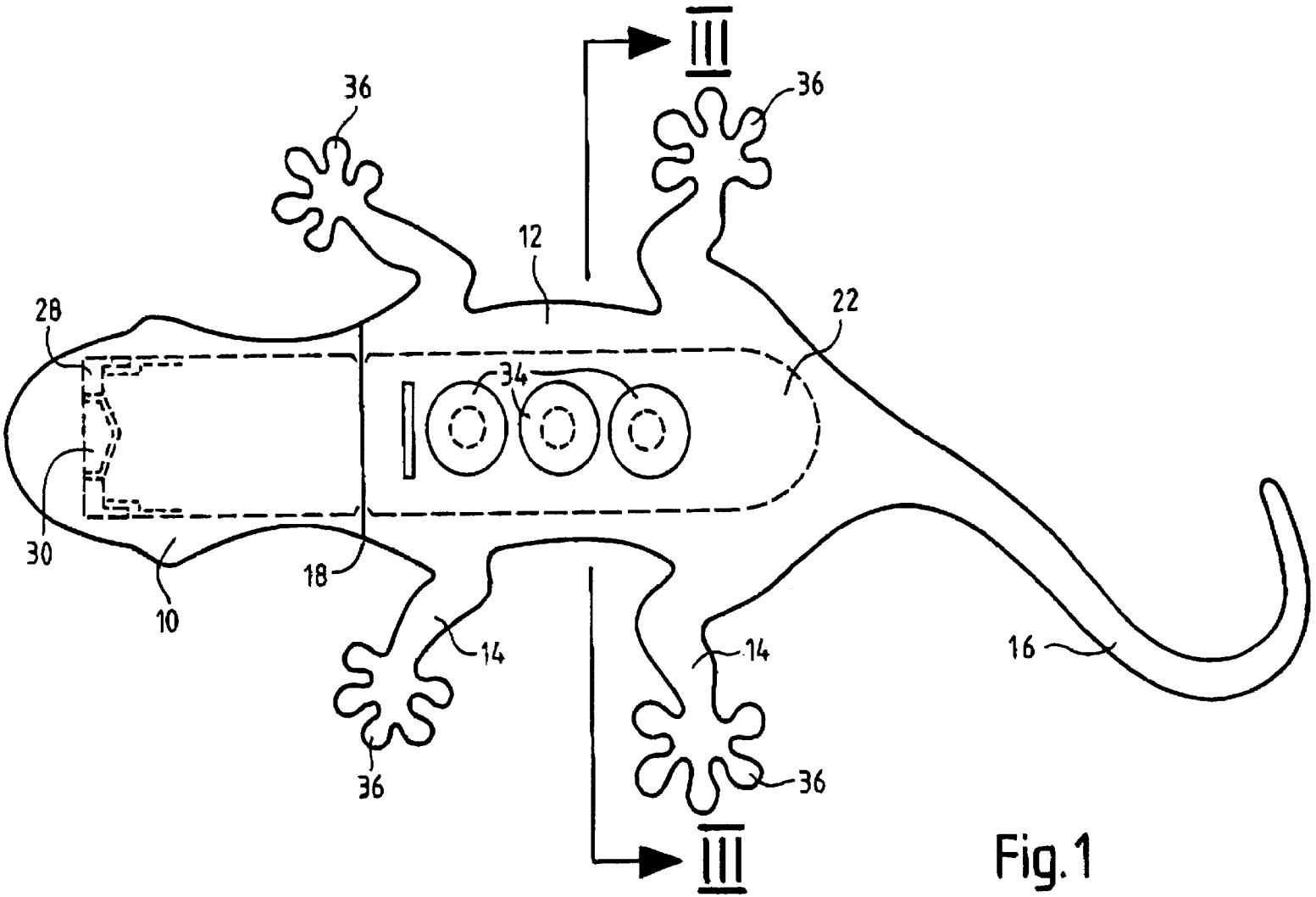
FIG. 1 is an underneath view of a liquid dispenser in accordance with the invention, the body being in the shape of a lizard.
Figure 2:
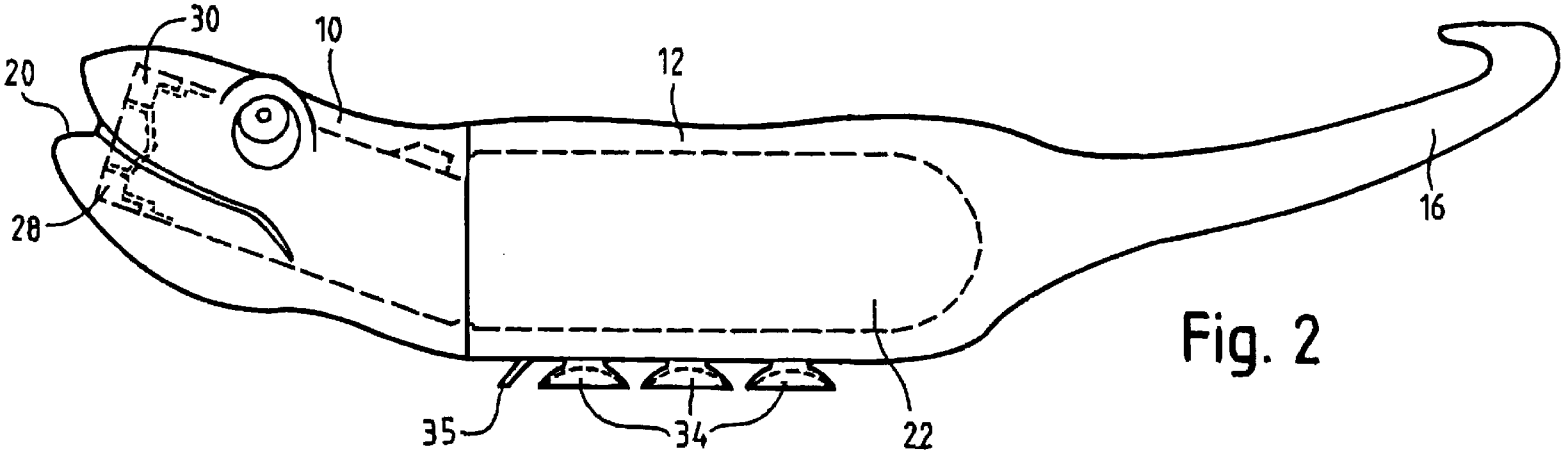
FIG. 2 is a side view of the dispenser of FIG. 1 with the legs omitted.
Figure 4:
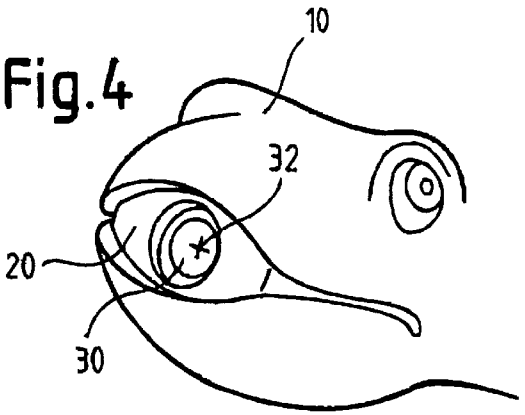
FIG. 4 is a detail showing the mouth of the dispenser.

FIG. 1 shows the body of the liquid dispenser, formed in the shape of a lizard. The lizard has a head 10, a body 12, legs 14 extending laterally from the body, feet 36 and a tail 16. The head 10 can be separated from the body 12 at a separation line 18 The head ends in a mouth 20 (FIGS. 2 and 4).

Both the body and the head are hollow and define cylindrical cavities in which a separate liquid container 22, forming a liquid reservoir, is fitted. The container is shown alone in FIG. 6 and is indicated in dotted lines in the views shown in FIGS. 1 and 2 and in cross-section in FIG. 3.

The container has a main section 24 which will be housed in the body 12 and a neck section 26 which will be housed in the head 10. At the top of the neck section is a mouth which is threaded to receive a screw-on cap 28. The cap can be removed to fill the container 22 through the neck, and then replaced. The cap incorporates a "Zel" valve 30 which controls dispensing operation of the liquid. The valve has a central alit 32 through which liquid is dispensed when the container is squeezed.

For initial filling of the dispenser, the head 10 of the lizard is removed, the cap 28 unscrewed and the container filled with the liquid to be dispensed, such as shampoo. The cap is screwed back on and the head 10 replaced. The body of the lizard is made of an elastomeric material and when the body is squeezed, the squeezing action is transmitted to the container which results in liquid being dispensed through the valve 30.

The body 12 has three suction cups 34 and a fin 35 on its underside. The cups 34 allow the body to be stuck against a vertical wall to hold the dispenser in places. The degree of suction provided by the cups should not be too great, as the dispenser is to be removed from the wall when it is squeezed to dispense liquid, and repositioned on the wall afterwards. Normally the dispenser will be placed on the wall with the lizard's mouth downwards, so that there is liquid immediately behind the valve when the dispenser is squeezed. When this happens, the fin 35 will make contact with the wall, with the tip of the fin pointing downwards. The tip of the fin 35 makes contact with the wall when the suction cups are pressed against the wall, the contact between the fin and the wall resists sliding of the dispenser down the wall.

Figure 5:
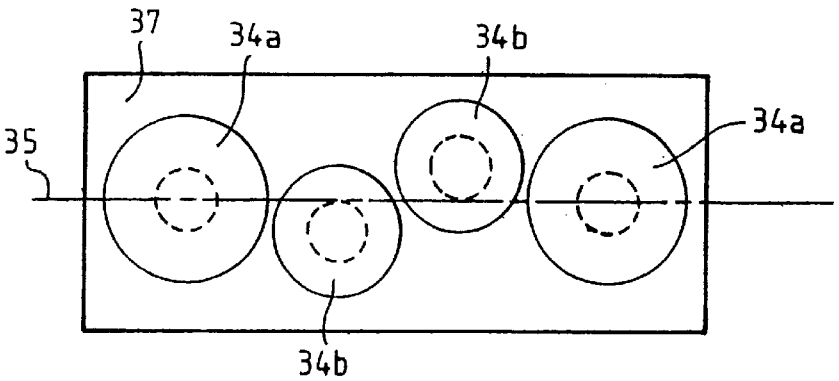
FIG. 5 shows an alternative arrangement of suction cups.

The cups 34 are positioned in line on the underside of the body. In the embodiment shown in FIGS. 1 and 2, there are three cups, but more or less could be provided. The number and positions of the cups will to some extent depend on the shape of the body. It is desirable that the cups should not be visible from in front when the body is stuck against a surface. FIG. 5 shows an alternative arrangement of two larger cups 34*a* and two smaller cups 34*b* arranged on a base 37. In order to achieve the correct degree of suction, this arrangement with offset smaller cups may be desirable to allow a larger suction area to be provided on a particular size of base.

The base 37 and cups may be a separate component which is mounted onto the body 12 at a subsequent production stage.

If the material of which the body is made has properties which make it suitable for suction cups, then the cups and the body can be made as a single, one-piece moulding. Alternatively, if the material needs to have different properties (or if the configuration is such that the desired shape cannot be obtained through a one-piece moulding, then the cups can be moulded with a cup base, and the cups with their base can be incorporated in the moulding of the body.

It will be seen in the drawings that the neck 26 of the container 22 is at an angle to the main part 24. In order to ensure that the container is inserted in the main body 12 with the correct orientation, the container and body can have interengaging ribs (not shown) which can only be engaged if the container and body are assembled in the correct orientation.

Figure 3:
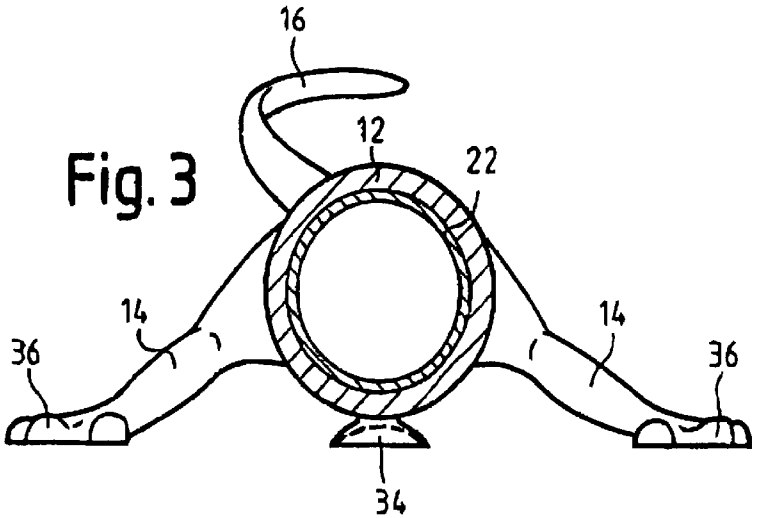
FIG. 3 is a cross section on the line III—III from FIG. 1.

FIG. 3 shows the arrangement of the legs 14. The legs end in feet 36 which have flat surfaces lying in a plane slightly above the plane of the suction cups 34. When the body is stuck against a surface by the suction cups, the feet should be just out of contact with the surface, so that the legs do not try to lift the cups off the surface on which they are stuck. The legs and tail are not rigid but have sufficient inherent stiffness to maintain their shape.

The container 22 has an annular groove 38 to receive corresponding annular ribs on the main part 12 and the head 10 of the body, to retain all the parts of the dispenser together, when assembled.

Figure 6:
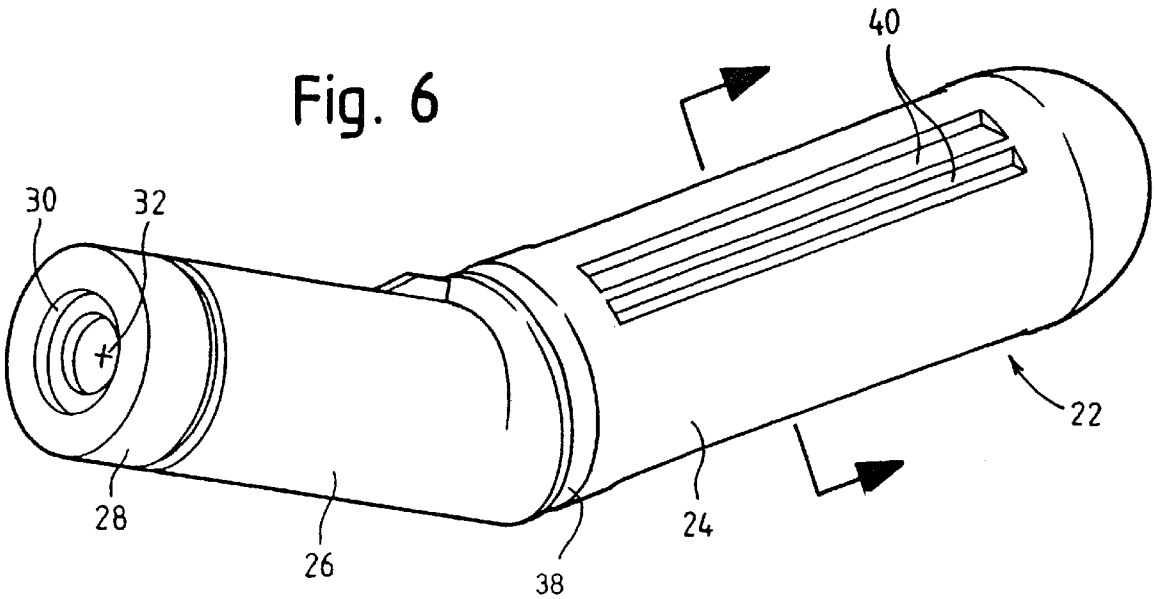
FIG. 6 shows a reservoir temporarily removed from the body for refilling.
Figure 7:
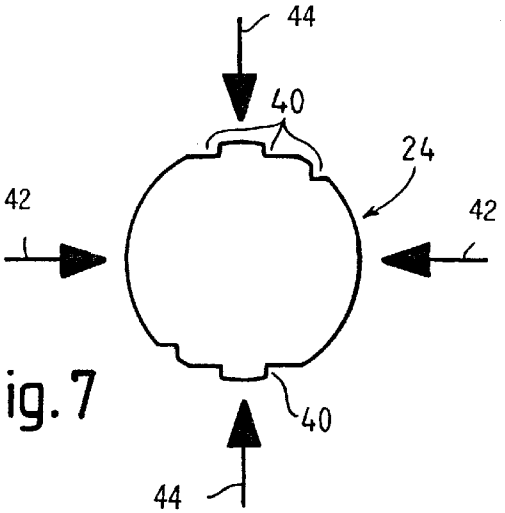
FIG. 7 is a cross-section through the reservoir taken on the lines VII—VII from FIG. 6.

The container also has longitudinal strakes 40 (FIGS. 6 and 7). These are designed so that the container is easier to squeeze in one direction than in another direction.

When the dispenser is pressed against a wall, to stick it on the wall, a force is applied between the top of the lizard and the wall. This force will act on the container in the direction shown by arrows 44. To dispense liquid, the container will however be squeezed in a direction at right angles, ie as indicated by the arrows 42. As the dimensions of the strakes 40 parallel to the arrows 44 are greater than they are parallel to the arrows 42, it will be more difficult to compress the container in the direction 44—44 than it will be in the direction 42—42.

As a result, the risk of dispensing liquid by the act of pressing the dispenser against a wall will be reduced.

When the reservoir is empty, it can be refilled. It would alternatively be possible to purchase an already filled reservoir to replace the empty one which would then be thrown away.

The ability to attach the dispenser to a wall or the side of a bath at any position makes it easy to use. The possibility of designing the housing into an attractive shape which can be unrelated to the contents to be dispensed enhances the appeal of the dispenser, particularly to children. Since the reservoir can be refilled many times, there will be a saving in packaging materials when compared with discardable bottles. All these factors make the invention as described here and attractive product for dispensing liquids.

What is claimed is:

1. A liquid dispenser comprising:

a housing having an inner cavity;

a resilient, refillable reservoir having an initial shape generally corresponding to a shape of said housing inner cavity and snugly received within said housing inner cavity, for containing a pourable liquid to be dispensed when said reservoir is squeezed, said resilient, refillable reservoir returning to said initial shape each time after being squeezed;

a closure for the reservoir which can be removed to allow the reservoir to be refilled with a pourable liquid and which, when refitted to the reservoir, includes dispensing means, which dispensing means includes a closure which closes automatically and is normally closed to prevent leakage of said pourable liquid but which opens to dispense said pourable liquid when the reservoir is squeezed, wherein the closure is located within the housing; and a plurality of suction cups formed on the housing, to allow the housing including the reservoir to be releasably attached to a vertical surface, wherein the strength of attachment of the suction cups to the vertical surface is sufficient to hold the dispenser to the surface while allowing it to be easily detached when liquid is to be dispensed.

2. A liquid dispenser as claimed in claim 1, wherein the housing takes the shape of an animal.

3. A liquid dispenser as claimed in claim 2, wherein the dispenser is arranged so that the pourable liquid is dispensed through the mouth of the animal shape.

4. A liquid dispenser as claimed in claim 1, wherein the housing is constructed in two pieces which can be separated to allow the resilient, refillable reservoir to be refilled.

5. A liquid dispenser as claimed in claim 4, wherein a refilling opening of the resilient, refillable reservoir is exposed when the two pieces of the housing are separated.

6. A liquid dispenser as claimed in claim 1, wherein the resilient, refillable reservoir can be inserted in or extracted from said cavity within the housing.

7. A liquid dispenser as claimed in claim 5, wherein the refilling opening of the reservoir is normally closed by a cap which includes the dispensing closure.

8. A liquid dispenser as claimed in claim 1, wherein the dispensing closure has a slit membrane providing the closure, with the membrane being distended to open the slit when said resilient, refillable reservoir is squeezed.

9. A liquid dispenser as claimed in claim 1, wherein three suction cups are provided.

10. A liquid dispenser as claimed in claim 1, wherein the housing is molded from an elastomeric plastics material.

11. A liquid dispenser as claimed in claim 9, wherein the suction cups are integrally molded with the housing.

12. A liquid dispenser as claimed in claim 10, wherein the plurality of suction cups are preformed and placed in a mold for the housing, so that the housing material is molded around the plurality of suction cups.

13. A liquid dispenser as claimed in claim 1, wherein the dispenser is generally elongate, with the plurality of suction cups in line.

14. A liquid dispenser as claimed in claim 13, wherein the housing has laterally extending limbs, designed as legs or arms of the animal shape, which help to ensure that the dispenser is correctly positioned against a surface to enable the suction cups to stick.

15. A liquid dispenser as claimed in claim 1 wherein said housing further includes a molded, angled fin, disposed proximate said plurality of suction cups, for resisting vertical sliding of said housing when said housing is attached to a vertical surface by said plurality of suction cups.

16. A liquid dispenser as claimed in claim 1 wherein said resilient, refillable reservoir further includes first and second sets of undulations, said first and second sets of undulations disposed generally on respective first and second opposite sides of said resilient, refillable reservoir, said first and second sets of undulations oriented proximate a top and a bottom region, respectively, of said housing when said resilient, refillable reservoir is received in said housing.

17. A liquid dispenser comprising:

a housing having an inner cavity;

a resilient, refillable reservoir having an initial shape generally corresponding to a shape of said housing inner cavity and snugly received within said housing inner cavity, for containing a pourable liquid to be dispensed when said reservoir is squeezed, said resilient, refillable reservoir returning to said initial shape each time after being squeezed;

a closure for the reservoir which can be removed to allow the reservoir to be refilled with a pourable liquid and which, when refitted to the reservoir, includes dispensing means, which dispensing means includes a closure which closes automatically and is normally closed to prevent leakage of said pourable liquid but which opens to dispense said pourable liquid when the reservoir is squeezed, wherein the closure is located within the housing;

a plurality of suction cups formed on the housing, to allow the housing including the reservoir to be releasably attached to a vertical surface, wherein the strength of attachment of the suction cups to the vertical surface is sufficient to hold the dispenser to the surface while allowing it to be easily detached when liquid is to be dispensed; and an angled fin, disposed on said housing proximate said plurality of suction cups, for resisting vertical sliding of said housing when said housing is attached to a vertical surface by said plurality of suction cups.

18. A liquid dispenser comprising:

a housing having an inner cavity;

a resilient, refillable reservoir having an initial shape generally corresponding to a shape of said housing inner cavity and snugly received within said housing inner cavity, for containing a pourable liquid to be dispensed when said reservoir is squeezed, said resilient, refillable reservoir returning to said initial shape each time after being squeezed, said resilient, refillable reservoir further including first and second sets of undulations, said first and second sets of undulations disposed generally on respective first and second opposite sides of said resilient, refillable reservoir, said first and second sets of undulations oriented proximate a top and a bottom region, respectively, of said housing when said resilient, refillable reservoir is received in said housing inner cavity;

a closure for the reservoir which can be removed to allow the reservoir to be refilled with a pourable liquid and which, when refitted to the reservoir, includes dispensing means, which dispensing means includes a closure which closes automatically and is normally closed to prevent leakage of said pourable liquid but which opens to dispense said pourable liquid when the reservoir is squeezed, wherein the closure is located within the housing; and a plurality of suction cups formed on the housing, to allow the housing including the reservoir to be releasably attached to a vertical surface, wherein the strength of attachment of the suction cups to the vertical surface is sufficient to hold the dispenser to the surface while allowing it to be easily detached when liquid is to be dispensed.

* * * * *